US005787812A

United States Patent [19]

Shoji

[11] Patent Number: 5,787,812

[45] Date of Patent: Aug. 4, 1998

[54] METHOD AND APPARATUS FOR MOUNTING A BLANKET FOR A ROTARY PRESS

[75] Inventor: Yukikazu Shoji, Mihara, Japan

[73] Assignee: Mitsubishi Jukogyo Kabushiki Kaisha, Tokyo, Japan

[21] Appl. No.: 779,443

[22] Filed: Jan. 7, 1997

[30] Foreign Application Priority Data

May 17, 1996 [JP] Japan ..... 8-123236

[51] Int. Cl.[6] ..... B41F 27/12

[52] U.S. Cl. ..... 101/415.1

[58] Field of Search ..... 101/415.1

[56] References Cited

U.S. PATENT DOCUMENTS

| | | | |
|---|---|---|---|
| 1,578,736 | 3/1926 | John | 101/415.1 |
| 2,986,085 | 5/1961 | Johnson | 101/415.1 |
| 3,166,012 | 1/1965 | Hantscho | 101/415.1 |
| 3,296,673 | 1/1967 | Kirkpatrick | 101/415.1 |
| 3,844,214 | 10/1974 | Smith | 101/415.1 |
| 4,090,302 | 5/1978 | Bollmer | 33/567 |
| 4,510,868 | 4/1985 | Fischer | 101/415.1 |
| 4,584,942 | 4/1986 | Sauer | 101/415.1 |
| 4,620,482 | 11/1986 | Fischer | 101/415.1 |
| 4,635,550 | 1/1987 | Brands et al. | 101/415.1 |

FOREIGN PATENT DOCUMENTS

| | | |
|---|---|---|
| 2 163 417 | 7/1973 | Germany . |
| 62-119039 | 5/1907 | Japan . |
| 3-182354 | 8/1991 | Japan . |
| 4-219242 | 8/1992 | Japan . |
| 07285214 | 4/1994 | Japan . |
| 08118603 | 10/1994 | Japan . |
| 756867 | 9/1956 | United Kingdom . |
| 8901866 | 3/1989 | WIPO . |

*Primary Examiner*—Edgar S. Burr
*Assistant Examiner*—Leslie Grohusky
*Attorney, Agent, or Firm*—Michael N. Meller

[57] ABSTRACT

An object of the present invention is to provide an economical and highly operable blanket mounting apparatus in which the width of a cylinder gap on a blanket cylinder is further decreased to eliminate a printing trouble such as shock-streak and to shorten the non printing length. To achieve this object, a flat bar 15*a*, 15*b* is installed at each end of a blanket 2, a notch 16 with the same size as that of the leading edge flat bar 15*a* is formed in a cylinder gap 3, the leading edge flat bar 15*a* of the blanket 2 is inserted along a leading edge opening 3*a* of the notch 16, and a tail edge 2*b* of the blanket 2 to which a flat bar 15*b* is fixed is reeled by a reel bar 14, by which the cylinder gap opening is blocked by the leading edge flat bar 15*a*.

5 Claims, 5 Drawing Sheets

METHOD AND APPARATUS FOR MOUNTING A BLANKET FOR A ROTARY PRESS

FIELD OF THE INVENTION AND RELATED ART STATEMENT

The present invention relates to a method and an apparatus for mounting a blanket for a rotary press and, more particularly, a method and an apparatus for mounting a blanket, which can reduce the vibration caused by a cylinder gap on a blanket cylinder and the length of an unprinted portion (hereinafter referred to as a non printing length).

A blanket cylinder of a printing machine comes in contact with a plate cylinder, a blanket cylinder or an impression cylinder, and rotates on the mating cylinder while cooperating with each other.

FIG. 6 shows a most basic cylinder arrangement for a printing unit on an offset printing machine. With this system, paper is made to pass between an outer blanket cylinder 61 and an inner blanket cylinder 62 to make printing on both faces of the paper at the same time. In FIG. 6, reference numerals 64 and 65 denote an outer plate cylinder and an inner plate cylinder, respectively.

On the blanket cylinder 61 (62) of such a printing machine, a blanket-mounting cylinder gap 3 for stretching a blanket 2 around the blanket cylinder is formed in parallel with the cylinder axis. The lower part of this cylinder gap 3 communicates with a through hole 67 for providing a blanket reel bar 54.

FIG. 7 shows a blanket mounting apparatus 50 which has so far been used generally. For this apparatus, a blanket having aluminum pieces 59, 59 pressed onto both ends thereof is used. The pieces 59, 59 at both ends of the blanket are inserted in a gap in two reel bars 54, 54 provided in the blanket cylinders respectively, and the blanket 2 is stretched around the blanket cylinder 1 by the double reel method by turning the reel bars 54, 54.

The cylinder gap 3 on the blanket cylinder 61 (62) of the printing machine meets the cylinder gap 3 of the rotating mating blanket cylinder 61 (62) every one rotation, and also meets a plate mounting gap 66 on the plate cylinder 64 (65). Therefore, when these cylinder gaps 3, 3 meet each other during rotation, a printing pressure is released in a moment, which creates a large disturbing force acting on the printing machine, resulting in a printing trouble such as a lateral stripe called shock-streak on the print surface.

Also, since ink does not stick to the portion of this cylinder gap 3, a greater gap width increases the non printing length. Therefore, various improvements have been made conventionally on the blanket mounting apparatus to prevent the shock-streaks and to shorten the non printing length.

FIG. 8 shows a publicly known double reel type blanket mounting apparatus 40 which has been developed to prevent the shock-streaks. On this apparatus, an elastic filler 48 is installed at the opening between a leading edge 2*a* and a tail edge 2*b* of the blanket 2 at the cylinder gap 3. The edges 2*a* and 2*b* of the blanket 2 are inserted into gaps of respective reel bars 44.

FIG. 9 shows a publicly known blanket mounting apparatus 30 which has recently been developed to prevent the shock-streaks and to shorten the non printing length. On this apparatus, a blanket 2 is affixed to the surface of a base plate 32 using a form plate material, and a mechanism 34 of a plate lock up device for plate cylinder, which can decrease the cylinder gap width, is applied.

FIG. 10 shows a single reel type blanket mounting apparatus 20 which has recently been developed and widely used now to prevent the shock-streaks and to shorten the non printing length. On this apparatus, a blanket 2 having thin flat bars 25*a*, 25*b* affixed on one side at both ends thereof is used so as to decrease the width of a cylinder gap 3 on a blanket cylinder 1 to the limit point such that there is no The difficulty in mounting the blanket 2. The flat bar 25*b* is inserted into the gap of a reel bar 24.

As described above, various improvements have been made on the blanket mounting apparatus for the rotary press, but there still remain the following problems.

(1) The width of the cylinder gap on the blanket cylinder practically used at present has already been decreased to the utmost, reaching the limit point such that there is no difficulty in mounting the blanket. Accordingly, with the present method, the cylinder gap width cannot be decreased to shorten the non printing length and to prevent a printing trouble such as shock-streak.

(2) There is a method in which an elastic filler is installed at the opening of cylinder gap to prevent a printing trouble such as shock-streak caused by vibration. With this method, however, the non printing length cannot be shortened. Also, it is difficult to control the height of the filler so as to be flush with the outer surface of the blanket cylinder.

(3) There is a method in which a blanket is affixed onto the surface of base plate using a form plate material to shorten the non printing length by making use of the fact that the width of the press plate mounting cylinder gap on the plate cylinder can be made smaller than the width of the cylinder gap on the blanket cylinder. With this method, however, the running cost is high, and when the blanket becomes thin during use, it is difficult to solve the problem by using an under packing.

OBJECT AND SUMMARY OF THE INVENTION

Accordingly, an object of the present invention is to solve the above remaining problems and to provide an economical and highly operable blanket mounting method and apparatus in which the width of a cylinder gap on a blanket cylinder is further decreased to eliminate a printing trouble such as shock-streak and to shorten the non printing length.

To achieve the above object, the present invention provides a blanket mounting method characterized in that on a blanket mounting apparatus of a type such that the tail edge of a blanket having a flat bar fixed at each end is reeled by a blanket reel bar provided at the lower part of a cylinder gap on a blanket cylinder, a notch with the same size as that of the leading edge flat bar of the blanket is provided along the leading edge opening of the cylinder gap, and the leading edge flat bar of the blanket is inserted in the notch to mount the blanket around the cylinder.

Also, the present invention provides, as an apparatus for using the above method, a blanket mounting apparatus characterized in that on a blanket mounting apparatus of a type such that the tail edge of a blanket having a flat bar fixed at each end is reeled by a blanket reel bar provided at the lower part of a cylinder gap on a blanket cylinder, a notch with the same size as that of the leading edge flat bar of the blanket is formed along the leading edge opening of the cylinder gap so that the leading edge flat bar of the blanket is inserted therein.

On the blanket mounting apparatus in accordance with the present invention, the gap width including the notch formed at the leading edge opening of the cylinder gap on the blanket cylinder is preferably equal to the dimension of the maximum thickness of two blankets plus the thickness of the leading edge flat bar of the blanket.

For the blanket mounting method and apparatus in accordance with the present invention, since the above measures are taken, when the blanket is mounted around the blanket cylinder, the tail edge of the blanket is first inserted in the gap of the reel bar in the blanket cylinder. Then, the leading edge is inserted in the notch formed at the opening of the cylinder gap on the blanket cylinder.

At this time, the leading edge is pushed into the notch until the tip end of the leading edge flat bar of the blanket comes in contact with the lower face of the notch. Finally, the blanket reel bar is turned to stretch the blanket around the blanket cylinder. Thereby, the notch formed at the opening of the cylinder gap on the blanket cylinder is blocked by the leading edge flat bar of the blanket, so that the width of the gap on the blanket cylinder is decreased by the thickness of the flat bar as if a filler with a thickness of flat bar is inserted. Also, since the gap width of the blanket cylinder excluding the width of the notch at the opening of the cylinder gap is formed into a dimension equivalent to the maximum thickness of two blankets, the leading edge and the tail edge of the blanket come in contact with each other at the entrance of the gap on the blanket cylinder, so that the non printing length caused by the gap width of the blanket cylinder can be decreased to a dimension equivalent to the maximum thickness of two blankets.

Therefore, the disturbing force during operation and the non printing length can be reduced significantly by the decrease in gap width.

DETAILED DESCRIPTION OF PREFERRED EMBODIMENTS

One embodiment of a method and an apparatus for mounting a blanket in accordance with the present invention will be described in detail with reference to FIGS. 1 to 4.

Figure 1:
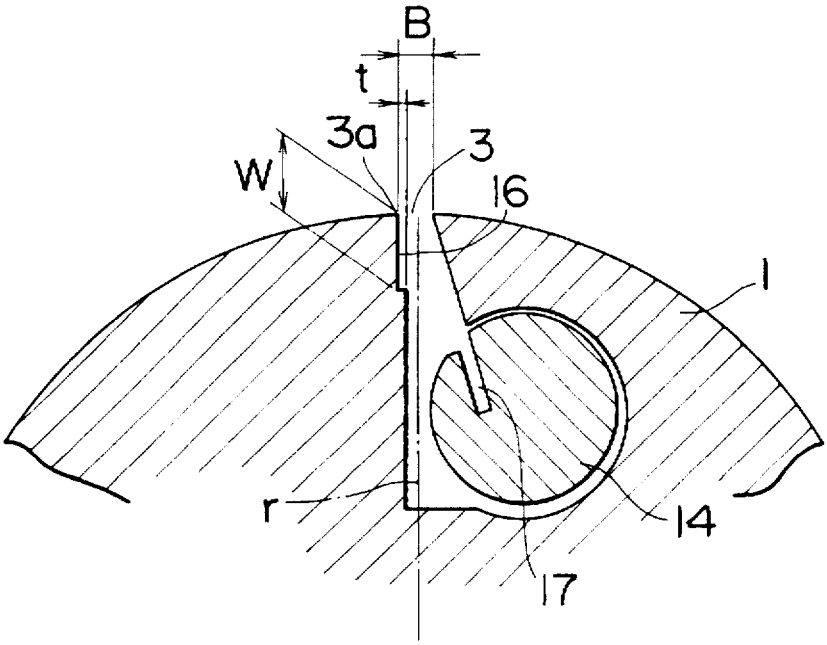
FIG. 1 is a sectional view of the principal portion of a blanket mounting apparatus in accordance with one embodiment of the present invention, showing a state of a blanket cylinder before a blanket is mounted.
Figure 2:
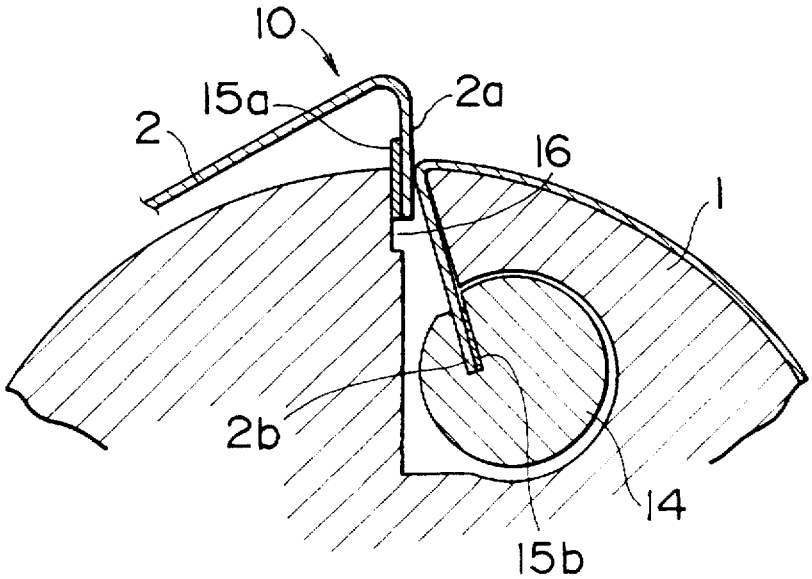
FIG. 2 is a sectional view of the principal portion similar to FIG. 1, showing a state when the blanket is being mounted.
Figure 3:
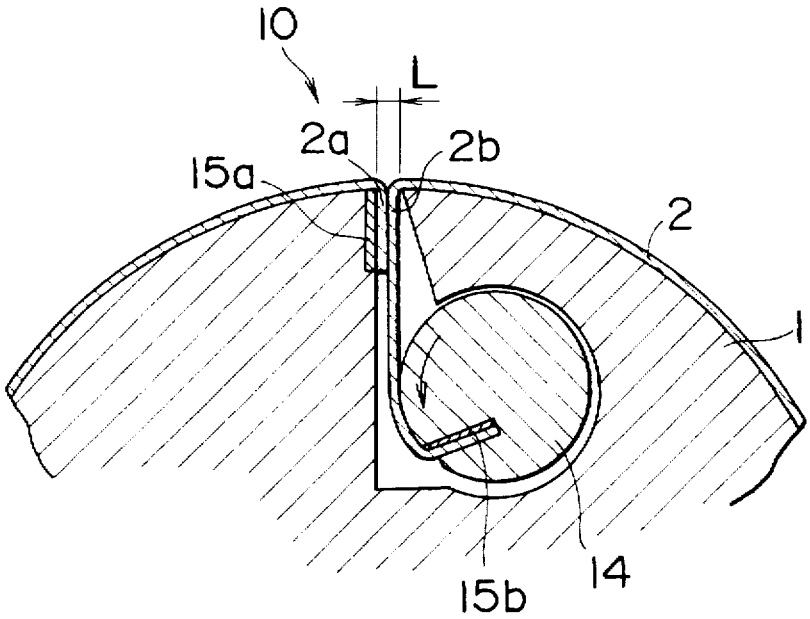
FIG. 3 is a sectional view of the principal portion similar to FIG. 1, showing a state when the blanket has been mounted.
Figure 4:
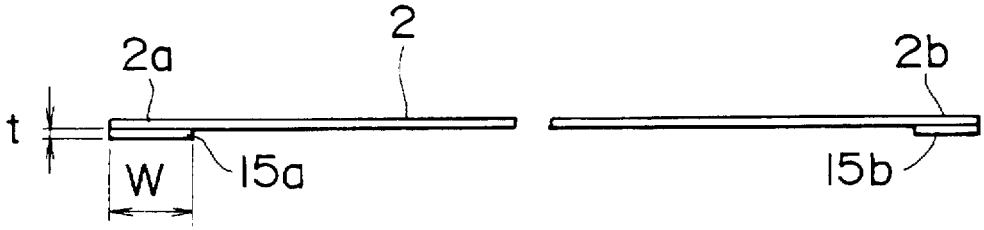
FIG. 4 is a side view of a blanket used on the apparatus of the embodiment shown in FIG. 3.
Figure 5:
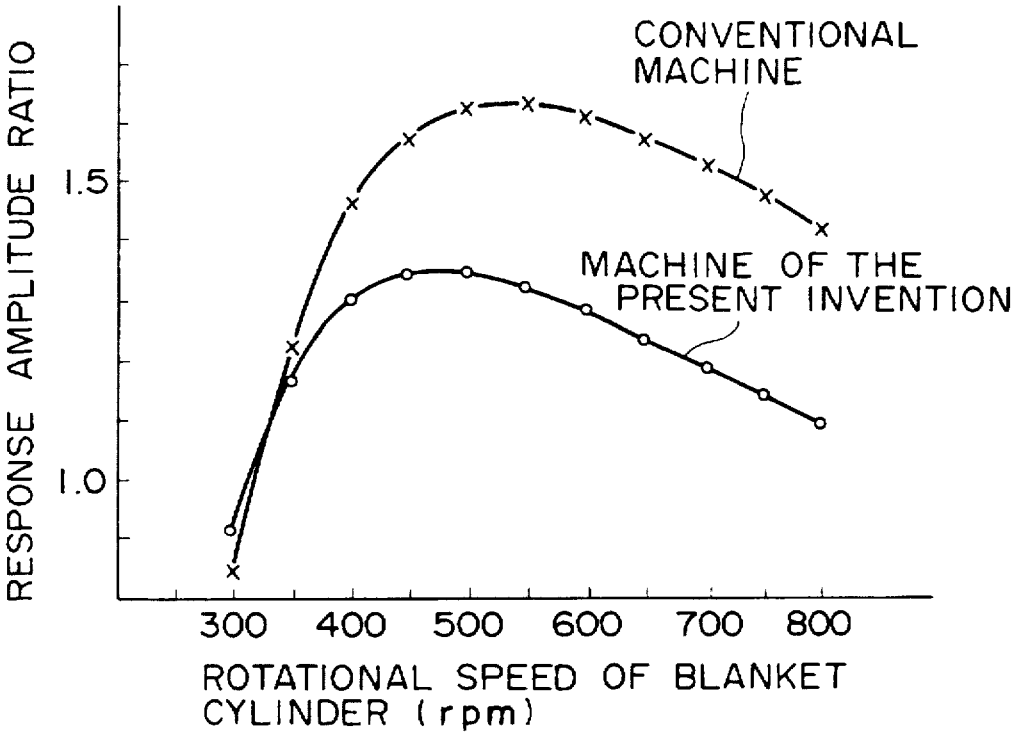
FIG. 5 is a graph showing an effect of the apparatus of the embodiment shown in FIG. 3.
Figure 6:
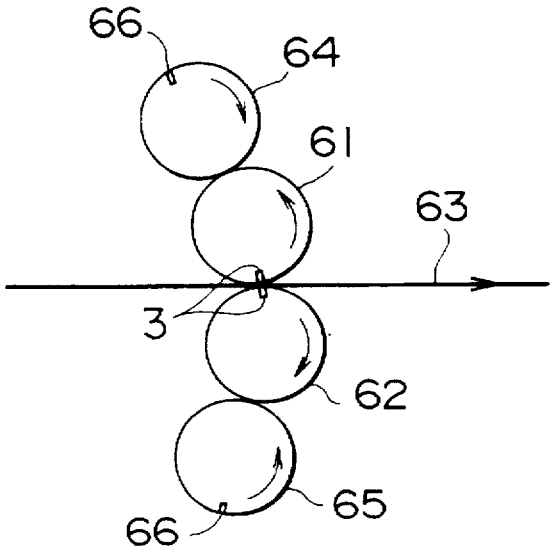
FIG. 6 is a view for illustrating the cylinder arrangement for a basic offset printing unit.
Figure 7:
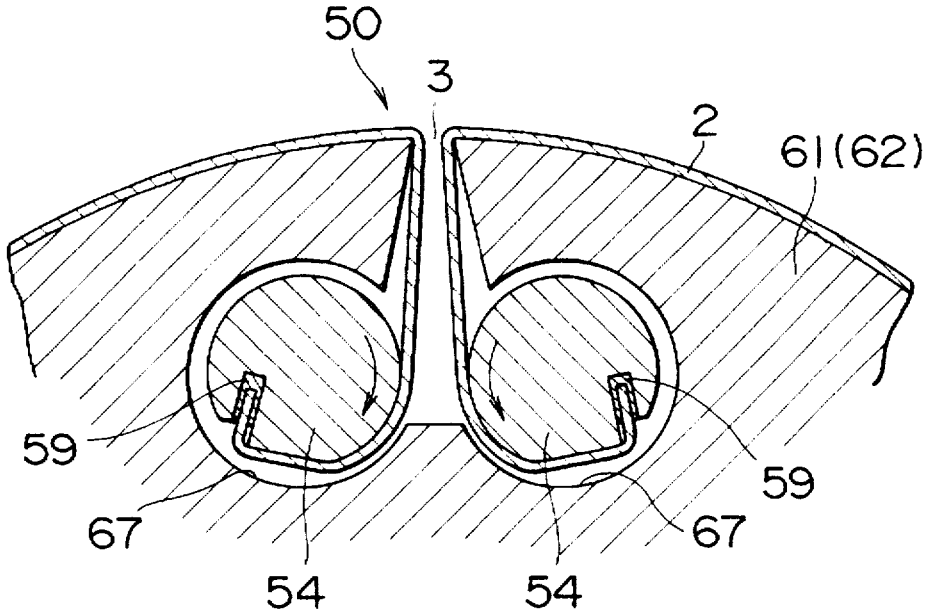
FIG. 7 PRIOR ART
FIG. 7 is a sectional view of the principal portion of a conventional double reel type blanket mounting apparatus.
Figure 8:
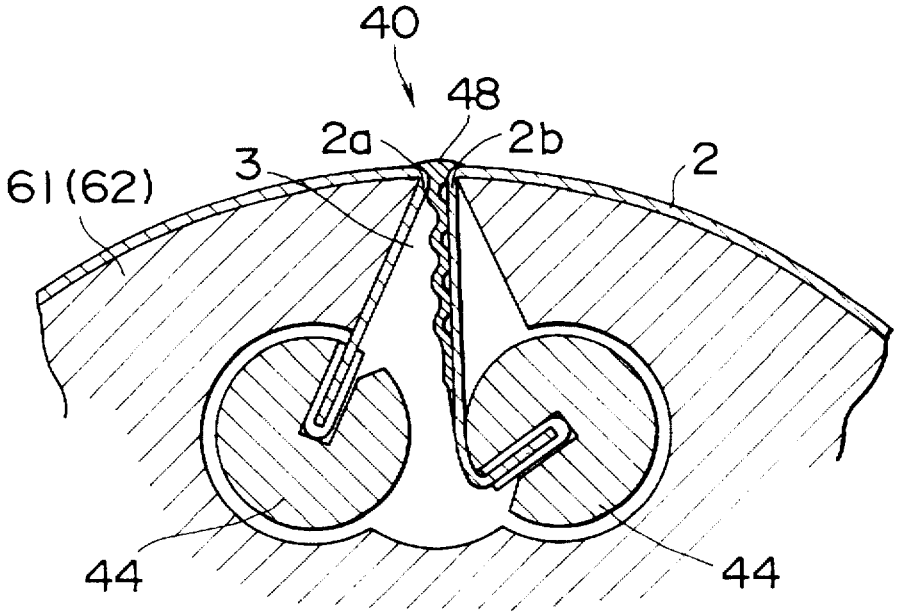
FIG. 8 PRIOR ART
FIG. 8 is a sectional view of the principal portion of a conventional blanket mounting apparatus with a filler.
Figure 9:
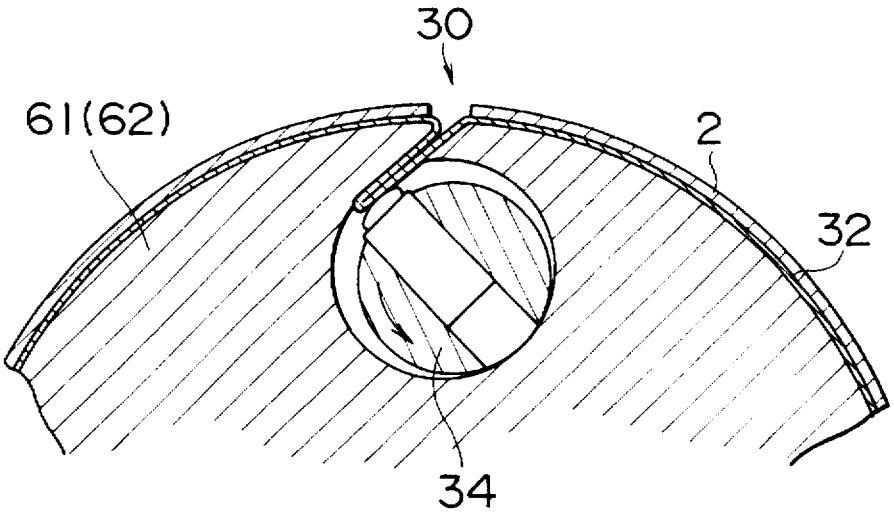
FIG. 9 PRIOR ART
FIG. 9 is a sectional view of the principal portion of a conventional plate lock up type blanket mounting apparatus.
Figure 10:
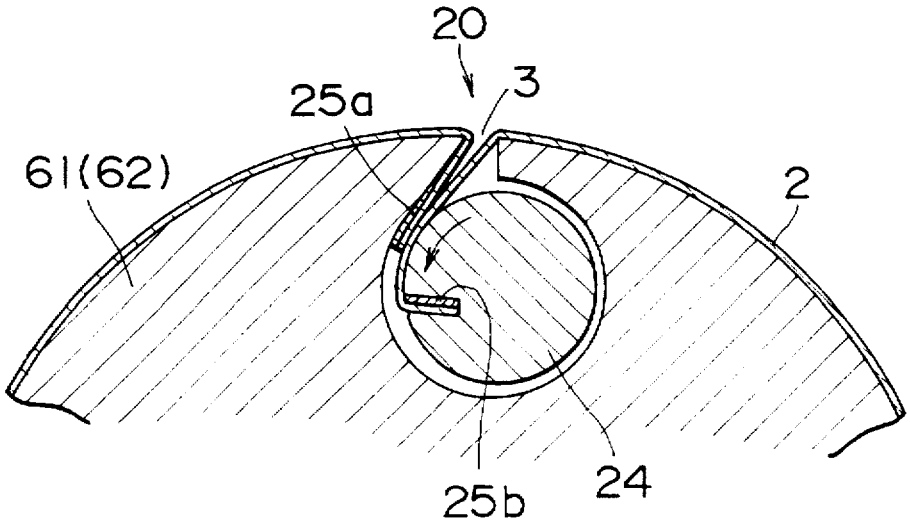
FIG. 10 PRIOR ART
FIG. 10 is a sectional view of the principal portion of a conventional single reel type blanket mounting apparatus.

FIGS. 1 to 3 are sectional views of the principal portion of a blanket mounting apparatus in accordance with one embodiment of the present invention. FIG. 1 shows a state of a blanket cylinder before a blanket is mounted, FIG. 2 shows a state when the blanket is being mounted, and FIG. 3 shows a state when the blanket has been mounted. FIG. 4 is a side view of a blanket used in this embodiment, and FIG. 5 is a graph showing an effect achieved by this embodiment.

Next, the configuration of an apparatus of this embodiment will be described. In FIGS. 1 to 4, reference numeral 10 denotes a blanket mounting apparatus in accordance with this embodiment, 1 denotes a blanket cylinder thereof, 2 denotes a blanket stretched around the blanket cylinder 1, 3 denotes a blanket mounting cylinder gap formed in parallel with the axis of the blanket cylinder 1, and 14 denotes a blanket reel bar provided at the bottom part of the cylinder gap 3.

On the blanket 2 for the apparatus of this embodiment, as shown in FIG. 4, steel flat bars 15a on the leading edge side and 15*b* on the tail edge side are affixed to the leading edge 2*a* and the tail edge 2*b* at both ends, respectively.

In the blanket mounting cylinder gap 3 on the blanket cylinder 1, as shown in FIG. 1, a notch 16, whose depth and width are equal to the width w and thickness t of the flat bar on the leading edge side of the blanket, respectively, is formed on the surface parallel with the radius r passing the center of the cylinder gap 3 along a leading edge opening 3*a*of the cylinder gap 3.

The cylinder gap 3 is so formed that the apparent width B thereof on the blanket cylinder 1 including the width of the notch 16 at the leading edge opening 3*a* is equal to the maximum thickness of two blankets plus the thickness t of the flat bar 15*a* on the leading edge side.

On one blanket reel bar 14 provided at the lower part of the cylinder gap 3, as shown in FIG. 1, a gap 17 is formed to insert the tail edge 2*b* of the blanket, and this reel bar is configured so as to be turned via a worm gear mechanism, not shown.

For the blanket mounting apparatus 10 in accordance with this embodiment, since the above-described measures are taken, when the blanket 2 is mounted on the blanket cylinder 1, as shown in FIG. 2, the tail edge 2*b* of the blanket 2 is first inserted in the gap 17 of the blanket reel bar 14. Then, the leading edge 2*a* of the blanket 2 is inserted in the notch 16 formed at the leading edge opening 3*a* of the cylinder gap 3 on the blanket cylinder.

At this time, the leading edge 2*b* is pushed into the notch 16 until the tip end of the leading edge flat bar 15*a* of the blanket 2 comes in contact with the lower face of the notch 16. Finally, the blanket reel bar 14 is turned in the arrow-marked direction via a worm gear, not shown, for tightening, so that the blanket 2 is stretched around the blanket cylinder 1.

Thus, the notch 16 formed at the leading edge opening 3*a* of the cylinder gap 3 on the blanket cylinder 1 is blocked by the leading edge flat bar 15*a* of the blanket 2, so that as shown in FIG. 3, the leading edge 2*a* and the tail edge 2*b* of the blanket 2 come in contact with each other at the portion where the blanket 2 enters the cylinder gap 3.

Therefore, the substantial width of gap on the blanket cylinder 1 is decreased by the thickness t of the leading edge flat bar 15*a*, becoming a dimension equivalent to the maximum thickness of two blankets, so that a state as if a filler with the thickness t of the flat bar 15*a* is inserted is established.

As a result, the non printing length L produced by the gap width of the blanket cylinder can be decreased to a dimension equivalent to the maximum thickness of two blankets. By this decrease in gap width, a disturbing force generated when the cylinder gap 3 on the blanket cylinder 1 meets the cylinder gap 3 of the mating cylinder cooperating with each other can be reduced significantly.

FIG. 5 shows the relationship between the rotational speed of the blanket cylinder 1 and the response amplitude ratio. In this figure, x mark indicates the case of the above-described advanced type conventional blanket mounting apparatus 20, and 0 mark indicates the case of the blanket mounting apparatus 10 of the present invention.

As is evident from FIG. 5, when the apparatus 10 of the present invention is used, the response amplitude ratio can be reduced by about 20% over the whole range of normal speed as compared with the conventional apparatus 20. Therefore, as the operating speed increases, the effect of decreased vibration increases.

Thus, for the blanket mounting apparatus 10 in accordance with the present invention, the substantial gap width of the blanket cylinder 1 is decreased to shorten the non printing length L, and the vibration during operation is reduced significantly, by which high-quality printed matters without a printing trouble such as shock-streak can be obtained over the whole range of the used rotational speed of rotary press.

The present invention achieves the following effects because the leading edge flat bar is inserted in the notch formed at the leading edge opening of the cylinder gap on the blanket cylinder.

(1) The cylinder gap opening on the blanket cylinder is blocked by the leading edge flat bar of the blanket as if a filler is installed in the cylinder gap, so that the disturbing force caused by the meeting-with the mating cylinder gap is reduced. Therefore, high-quality printing without a printing trouble such as shock-streak caused by vibration can be performed.

(2) The non printing length caused by the cylinder gap on the blanket cylinder is shortened to a dimension equivalent to the maximum thickness of two blankets, approaching the width of the cylinder gap on the plate cylinder. Therefore, the printable area is increased, so that printed matters can be obtained efficiently.

(3) When the tail edge of the blanket is inserted in the cylinder gap, the insertion work in the blanket reel bar is easy because the opening width of the cylinder gap is widened by the width of the notch. Also, the leading edge of the blanket is simply inserted in the notch. Therefore, the work for mounting the blanket is made easy.

Therefore, the present invention provides a blanket mounting apparatus in which the non printing length is shortened by further decreasing the width of the cylinder gap on the blanket cylinder, and high-grade printing without a printing trouble such as shock-streak can be performed by decreasing the change in printing pressure, and moreover the operability is excellent.

I claim:

1. In a rotary press apparatus having a blanket cylinder, said cylinder having a gap in the cylindrical surface thereof substantially parallel to the axis of said cylinder and adapted to receive a rotary press blanket therein, said blanket having a leading and a tail edge, the improvement wherein:

a reel bar is rotatably mounted in said cylinder and adapted to receive the tail edge of said blanket;

said gap in said cylindrical surface having a notch formed therein with a first notch surface substantially parallel to the radius of said cylinder and extending to the surface of said cylinder and a second lower notch surface;

first mounting means attached to the leading edge of said blanket; and second mounting means attached to the tail edge of said blanket, whereby when said tail edge of said blanket is inserted through said gap to contact said reel bar and said leading edge of said blanket is inserted into said notch until said first mounting means contacts said lower surface of said notch, said gap is substantially closed.

2. Apparatus as claimed in claim 1 wherein said notch has a preselected width and said first mounting means is a flat bar having said preselected width so that when said leading edge of said blanket is inserted into said notch, said first mounting means substantially fills said notch.

3. Apparatus as claimed in claim 2 wherein the width of said gap substantially equals the thickness of said flat bar plus twice the thickness of said blanket so that when said blanket is inserted into said gap, said first mounting means and said blanket substantially fill said entire gap.

4. In a method for mounting a rotary press blanket in an apparatus having a blanket cylinder, said cylinder having a gap in the cylindrical surface thereof substantially parallel to the axis of the cylinder, said gap having a notch formed therein, said blanket having a leading and a tail edge, the improvement comprising the steps of:

forming said notch with a first notch surface substantially parallel to a radius of said cylinder and extending to the surface of said cylinder and with a second lower notch surface;

providing a first mounting means on the leading edge of the blanket and a second mounting means on the tail edge of the blanket;

first inserting the tail edge of said blanket through said gap to the interior of said cylinder;

inserting said leading edge of said blanket into said notch formed in said gap until it contacts said second lower notch surface; and rotating said tail edge within said cylinder in a direction to tighten said blanket about the surface of said cylinder while simultaneously substantially filling said gap and notch with said blanket.

5. A method as claimed in claim 4 wherein said gap has a width equal to said thickness of said leading edge of said blanket plus twice the thickness of said blanket so that said gap is substantially closed by said blanket as said blanket is tightened about said surface of said cylinder.

* * * * *